United States Patent [19]

Kadija

[11] 4,216,072

[45] Aug. 5, 1980

[54] DIAPHRAGMS FOR USE IN THE ELECTROLYSIS OF ALKALI METAL CHLORIDES

[75] Inventor: Igor V. Kadija, Cleveland, Tenn.

[73] Assignee: Olin Corporation, New Haven, Conn.

[21] Appl. No.: 850,187

[22] Filed: Nov. 10, 1977

Related U.S. Application Data

[63] Continuation-in-part of Ser. No. 836,636, Sep. 26, 1977, Pat. No. 4,184,939, and Ser. No. 838,600, Oct. 3, 1977, Pat. No. 4,165,271.

[51] Int. Cl.[2] ..... C25B 13/04; C25B 1/34

[52] U.S. Cl. ..... 204/252; 204/295; 204/296

[58] Field of Search ..... 204/295, 296, 252

[56] References Cited

U.S. PATENT DOCUMENTS

| | | | |
|---|---|---|---|
| 621,908 | 3/1899 | Dow | 204/295 X |
| 1,291,253 | 1/1919 | Thatcher | 204/295 UX |
| 1,742,411 | 1/1930 | Muller | 204/295 UX |
| 3,583,891 | 6/1971 | Hacker | 204/295 X |
| 3,702,267 | 11/1972 | Grot | 429/34 |
| 3,847,762 | 11/1974 | Strain | 204/98 |
| 3,847,762 | 11/1974 | Strain | 204/98 |
| 4,031,000 | 6/1977 | Nakamura et al. | 204/252 |
| 4,032,427 | 6/1977 | Kadija | 204/283 |
| 4,081,350 | 3/1978 | Kadija et al. | 204/295 |

FOREIGN PATENT DOCUMENTS

| | | | |
|---|---|---|---|
| 99199 | 2/1925 | Austria | 204/295 |
| 78732 | 12/1894 | Fed. Rep. of Germany | 204/295 |
| 47-49424 | 12/1972 | Japan | 204/296 |
| 50-26770 | 3/1975 | Japan | 204/296 |
| 76-21598 | 2/1976 | Japan | 204/295 |

*Primary Examiner*—F. Edmundson

*Attorney, Agent, or Firm*—James B. Haglind; Donald F. Clements

[57] ABSTRACT

A diaphragm for use in the electrolysis of alkali metal chloride brines in electrolytic diaphragm cells is comprised of a support fabric impregnated with a mixture of a non-fibrous component containing silica and glass fibers. The diaphragms are physically and chemically stable and have increased operational life.

45 Claims, No Drawings

DIAPHRAGMS FOR USE IN THE ELECTROLYSIS OF ALKALI METAL CHLORIDES

This application is a continuation-in-part of co-pending application Ser. No. 836,636, filed Sept. 26, 1977, and now U.S. Pat. No. 4,184,939 application Ser. No. 838,600, filed Oct. 3, 1977 now U.S. Pat. No. 4,165,271.

This invention relates to diaphragm-type electrolytic cells for the electrolysis of aqueous salt solutions. More particularly, this invention relates to novel diaphragms for electrolytic diaphragm cells.

For years commercial diaphragm cells have been used for the production of chlorine and alkali metal hydroxides such as sodium hydroxide which employed a porous diaphragm of asbestos fibers. In employing asbestos diaphragms, it is thought that the effective diaphragm is a gel layer formed within the asbestos mat. This gel layer is formed by the decomposition of the asbestos fibers. In addition to undergoing chemical decomposition during operation of the cell when electrolyzing alkali metal chloride solutions, the asbestos fibers also suffer from dimensional instability as they are distorted by swelling. Porous asbestos diaphragms while satisfactorily producing chlorine and alkali metal hydroxide solutions, have limited cell life and once removed from the cell, cannot be re-used. Further asbestos has now been identified by the Environmental Protection Agency of the U.S. Government as a health hazard.

Recently it has been discovered that diaphragms can be produced by impregnating support fabrics with a non-fibrous active component containing silica. The silicacontaining component should be capable of undergoing hydration when in contact with the electrolytes in the cell. As a result of this hydration, the active component containing silica produces a gel-like formation which is soluble to a degree in the catholyte liquor. It is desirable to control the rate of dissolution of the gel to provide a stable, long lasting gel which will extend the service life of the diaphragm while simplifying the operation of the cell.

It is an object of the prescnt invention to provide a diaphragm having increased stability and a longer operational life when employed in the electrolysis of alkali metal chloride solutions.

Another object of the present invention is the use of ecologically acceptable non-polluting materials in diaphragm compositions.

An additional object of the present invention is a diaphragm having support materials which are chemically and physically stable during electrolysis.

A further object of the invention is the production of diaphragms having reduced costs for materials.

A still further object of the present invention is a diaphragm which can be handled easily during installation in and removal from the electrolytic cell.

These and other objects of the invention will be apparent from the following description of the invention.

Briefly, the novel porous diaphragm of the present invention for an electrolytic cell for the electrolysis of alkali metal chloride brines comprises a support fabric impregnated with a mixture comprising a non-fibrous component containing silica and glass fibers.

The porous diaphragm of the present invention has as one of its active ingredients, a non-fibrous component containing silica. For the purposes of this invention, silica is equivalent to silicon dioxide. The component containing silica should be capable of undergoing hydration when in contact with the electrolytes in the cell. A large number of silica-containing materials can be used including sand, quartz, silica sand, colloidal silica, as well as chalcedony, cristobalite and tripolite, with sand, quartz, silica sand and colloidal silica being preferred. Also suitable are alkali metal silicates such as sodium silicate, potassium silicate and lithium silicate; alkaline earth metal silicates such as magnesium silicates or calcium silicates; and aluminum silicates. In addition, a number of minerals can be suitably used as the silica-containing ingredient including magnesium-containing silicates such as sepiolites, meerschaums, augites, talcs, and vermiculties. Preferred magnesium-containing silicates include magnesium silicates, sepiolites and meerschaums. Magnesium-aluminum-containing silicates such as attapulgites, montmorillonites and bentonites, and alumina-containing silicates such as albites, feldspars, labradorites, microclines, nephelites, orthoclases, pyrophyllites, and sodalites, as well as natural and synthetic zeolites can also be employed.

Mixtures of various non-fibrous components containing silica can be used. For example, mixtures of a silica-containing material such as sand with a magnesium-containing silicate such as sepiolite or an alumina-containing silicate may be employed.

When using as the non-fibrous component a silica-containing material such as sand, quartz, silica sand, colloidal silica, chalcedony, cristobalite, tripolite, and alkali metal silicates, it may be desirable to include an additive which provides improved ionic conductivity and cation exchange properties. Suitable additives include, for example, magnesia, magnesium acetate, magnesium aluminate, magnesium carbonate, magnesium chloride, magnesium hydroxide, magnesium oxide, magnesium peroxide, magnesium silicate, magnesite, periclase, dolomites, alumina, aluminum acetate, aluminum chlorate, aluminum chloride, aluminum hydroxide, aluminum oxides ($\alpha$, $\beta$ and $\gamma$), aluminum silicate, corundum, bauxites as well as lime, lithium salts such as lithium chloride and lithium nitrate, inorganic phosphates such as aluminum phosphates and sodium phosphates. Preferred as additives are magnesium chloride, magnesium silicate, and magnesium hydroxide.

The additives may be used in amounts of from about 10 to about 70 and preferably from about 20 to about 50 percent by weight of the non-fibrous component containing silica.

The presence of metals other than alkali metals, alkaline earth metals and aluminum can be tolerated at low concentrations. For example, the concentration of metals such as Fe, Ni, Pb, Ag as well as other heavy metals which may be present in the alkali metal chloride brines electrolyzed are preferably below one part per million. Where these metals are found in the silica-containing materials, it is preferred that their concentration be less than about 5 percent of the concentration of silicon present in the material.

Concentrations of non-metallic materials such as fluorine or ammonia as well as organic compounds should also be maintained at moderate or preferably low levels.

The degree to which the non-fibrous component containing silica is hydrated is the basis for selecting suitable particle sizes of the component. For those materials which are readily hydrated in the electrolyte solutions used or produced in the cell, a particle size as large as about 100 microns is satisfactory. Where the component is less easily hydrated, the particle size may be substantially reduced. For these materials, particles having a size in the range of from about 75 microns to about one micron are more suitable.

Also present in the mixture for impregnating the support fabric are glass fibers which are also capable of undergoing hydration when in contact with the electrolytes in the cell. Suitable glass fibers include those produced from silica glass, alkali metal silicate glasses, aluminum silicate glasses, soda-lime glasses, and quartz glass. Of these, soda-lime glasses, aluminum silicate glasses and quartz glass are preferred embodiments with quartz glass being most preferred. Also suitable are inorganic oxide glasses such as cerium oxide glasses and germanium oxide glasses. The glass fibers having a length of from about 5 to about 50 millimeters, and preferably from about 5 to about 20 millimeters. Suitable fiber thicknesses include those from about 1 to about 200 microns, preferably from about 1 to about 100 microns, and more preferably from about 3 to about 17 microns.

As a support material for the mixture of the non-fibrous component containing silica and the glass fibers, a fabric is employed which is produced from thermoplastic materials which are chemically resistant to and dimensionally stable in the gases and electrolytes present in the electrolytic cell. The fabric support is substantially non-swelling, non-conducting and non-dissolving during operation of the electrolytic cell.

The fabric support has a thickness of from about 0.04 to about 0.33, preferably from about 0.06 to about 0.25, and more preferably from about 0.09 to about 0.18 of an inch. The fabric support is non-rigid and is sufficiently flexible to be shaped to the contour of an electrode, if desired.

Suitable fabric supports are those which can be handled easily without suffering physical damage. This includes handling before and after they have been impregnated with the active component. Suitable support fabrics can be removed from the cell following electrolysis, treated or repaired, if necessary, and replaced in the cell for further use without suffering substantial degradation or damage.

Support fabrics having uniform permeability throughout the fabric are quite suitable in diaphragms of the present invention. Prior to impregnation with the active component containing silica and coating with the electroconductive metal, these support fabrics should have a permeability to gases such as air of, for example, from about 1 to about 500, and preferably from about 50 to about 100 cubic feet per minute per square foot of fabric. However, fabrics having greater or lesser air permeability may be used. Uniform permeability throughout the support fabric is not, however, required and it may be advantageous to have a greater permeability in the portion of the support fabric which, when impregnated, will be positioned closest to the anode in the electrolytic cell. Layered structures thus may be employed as support fabrics having, a first layer which when the diaphragm is installed in the cell, will be in contact with the anolyte, and a second layer which will be in contact with the catholyte. The first layer may have, for example, a thickness of from about 0.09 to about 0.187 of an inch and an air permeability of, for example, from about 100 to about 500 cubic feet per minute. The first layer, may be, for example, a net having openings which are slightly larger than the particle size of the active ingredient with which it is impregnated.

The second layer, in contact with the catholyte when installed in the cell, may, for example, have a thickness of from about 0.03 to about 0.125 of an inch and an air permeability, for example, of from about 1 to about 15 cubic feet per minute. For the purpose of using a selected size of active component containing silica, the layered support fabric can be produced by attaching, for example, a net to a felt. The net permits the particles to pass through and these are retained on the felt.

Suitable permeability values for the support-fabric may be determined, for example, using American Society for Testing Materials Method D737-75, Standard Test Method for Air Permeability of Textile Fabrics.

The support fabrics may be produced in any suitable manner. Suitable forms are those which promote absorption of the active component including sponge-like fabric forms. A preferred form of support fabric is a felt fabric.

Materials which are suitable for use as support fabrics include thermoplastic materials such as polyolefins which are polymers of olefins having from about 2 to about 6 carbon atoms in the primary chain as well as their chloro- and fluoro- derivatives.

Examples include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride, and copolymers of ethylene-chlorotrifluoroethylene.

Preferred olefins include the chloro- and fluoro- derivatives such as polytetrafluoroethylene, fluorinated ethylene-propylene, polychlorotrifluoroethylene, polyvinyl fluoride, and polyvinylidene fluoride.

Also suitable as support materials are fabrics of polyaromatic compounds such as polyarylene compounds. Polyarylene compounds include polyphenylene, polynaphthylene and polyanthracene derivatives. For example, polyarylene sulfides such as polyphenylene sulfide or polynaphthylene sulfide. Polyarylene sulfides are well known compounds whose preparation and properties are described in the *Encyclopedia of Polymer Science and Technology*, (Interscience Publishers) Vol. 10, pages 653–659. In addition to the parent compounds, derivatives having chloro-, fluoro- or alkyl substituents may be used such as poly(perfluorophenylene) sulfide and poly(methylphenylene) sulfide.

In addition, fabrics which are mixtures of fibers of polyolefins and polyarylene sulfides can be suitably used.

The support fabrics may be impregnated with the mixture of the non-fibrous component containing silica and the glass fibers in any of several ways. For example, a slurry of the mixture in a solution such as cell liquor, is prepared and the support fabric is impregnated by soaking in the slurry. Another method is to attach the supporting fabric to the cathode and immerse the cathode in the slurry, using suction means to draw the slurry through the support fabric.

Additional methods of impregnating the support fabric include incorporating the glass fibers into the support fabric before adding the non-fibrous silica component. Glass fibers may be mixed into or needled into the support fabric and the glass fiber-containing support fabric impregnated with the non-fibrous silica component, for example, using the methods previously described.

It is not necessary to employ a solution or slurry for impregnation purposes. For example, the non-fibrous component containing silica may be used to form a fluidized bed. A vacuum is employed to suck the particles into the glass fiber-containing support fabric until the desired degree of impregnation is obtained.

When impregnated, the novel diaphragm of the present invention contains from about 10 to about 75, and preferably from about 30 to about 50 milligrams per square centimeter of the mixture of non-fibrous component containing silica and glass fibers.

Suitable mixtures of the non-fibrous component containing silica and glass fibers include those where the ratio by weight of the non-fibrous component containing silica to glass fibers is from about 1:4 to about 4:1, and preferably from about 2:3 to about 3:2.

The mixture of glass fibers and a non-fibrous component containing silica is capable of hydration in contact with an aqueous solution of a compound selected from the group consisting of alkali metal chlorides, alkali metal hydroxides, and mixtures of alkali metal chlorides and alkali metal hydroxides, preferably alkali metal hydroxides and mixture of alkali metal chlorides and alkali metal hydroxides.

During electrolysis or when in contact with the catholyte liquor produced in the cell, the mixture of the non-fibrous component containing silica and glass fibers produces a gel-like formation which is permeable to alkali metal ions. Gel formation is believed to occur during hydration of both the non-fibrous component containing silica and the glass fibers. The gel is believed to be soluble in the catholyte liquor and it is desirable that the rate of dissolution be controlled to maintain a suitable equilibrium between gel formation and dissolution for efficient operation of the cell. In the porous diaphragms of the present invention, this rate of dissolution is controlled by employing a mixture of the non-fibrous component containing silica, which has a relatively high rate of dissolution compared to that of the glass fibers, which are selected to provide a low rate of dissolution. While the gel-like formations may be produced throughout the diaphragm, they are normally produced within the support fabric in the portion which is adjacent to the anolyte side. The extent of gel formation within the support fabric varies, for example, with the thickness of the support fabric and the concentration of alkali metal hydroxide in the catholyte liquor. Preferred diaphragms are those in which the support fabric is impregnated with the mixture so that a portion of the support fabric is free of the mixture of the non-fibrous component containing silica and glass fibers. This portion has a thickness of from about 0.03 to about 0.125 of an inch.

Efficient cell operation is attained by controlling the equilibrium sufficiently to produce a caustic liquor containing silica in amounts of from about 10 to about 150 parts per million. Selection of suitable particle sizes for the non-fibrous component containing silica and the length and thickness of the glass fibers provides diaphragms which maintain this equilibrium over extensive time periods.

In another embodiment of the diaphragm of the present invention, glass fibers alone are used as the component which is hydrated to produce the gel-like formation. The glass fibers are located in a first portion of the support fabric with a second portion of the support fabric being free of glass fibers. This second portion has a thickness which represents from about 10 to about 70 percent of the total thickness of the diaphragm.

Following impregnation with the mixture of the non-fibrous component containing silica and glass fibers, or the glass fibers alone, the diaphragms have a permeability to alkali metal chloride brines of from about 100 to about 300, and preferably from about 150 to about 250 milliliters per minute per square meter of diaphragm at a head level difference between the anolyte and the catholyte of from about 0.1 to about 20 inches of brine.

The novel diaphragms of the present invention have handling properties which far exceed those of, for example, asbestos. The supported diaphragms can be removed from the cell, washed or treated to restore flowability, and replaced in the cell without physical damage. During operation of the cell, the novel diaphragms remain dimensionally stable with the support material neither swelling nor being dissolved or deteriorated by the electrolyte, the mixture containing non-fibrous silica and glass fibers or the cell products produced.

Electrolyte cells in which the diaphragms of the present invention may be used are those which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode assembly containing a plurality of foraminous metal anodes, a cathode assembly having a plurality of foraminous metal cathodes with the novel diaphragm separating the anodes from the cathodes. Suitable electrolytic cells include, for example, those types illustrated by U.S. Pat. Nos. 1,862,244; 2,370,087; 2,987,463; 3,247,090; 3,477,938; 3,493,487; 3,617,461; and 3,642,604.

When employed in electrolytic cells, the diaphragms of the present invention are sufficiently flexible so that they may be mounted on or supported by an electrode such as a cathode.

The porous diaphragms of the present invention are illustrated by the following examples without any intention of being limited thereby.

EXAMPLE 1

A section of felt 0.125 of an inch thick comprised of polytetrafluoroethylene fibers and glass fibers where the glass fibers constitute 25 percent of the fiber weight was used as the support fabric. The glass fibers were produced from C-glass, a low soda-lime glass, with fiber diameters of 3 to 5 microns and lengths of 20 to 30 millimeters. The glass fibers were randomly distributed throughout the felt fabric. The felt had an air permeability in the range of from about 20 to about 70 cubic feet per minute per square foot.

Sepiolite, having particle sizes in the range between 44 microns and less than 1 micron, was added to sodium chloride brine having a concentration of 295–305 grams per liter of NaCl. The sepiolite was dispersed in the brine using a blender until the brine contained about 5 percent by volume of sepiolite. Analysis of the sepiolite indicated oxides of the following elements were present as percent by weight: Si 79.1; Mg 9.3; K 4.8; Ca 4.8, Al 1.4 and Fe 1.4.

The polytetrafluoroethylene-glass fiber felt was washed in a caustic soda solution containing 15–20 percent NaOH and at a temperature of 30° C. for about 24 hours to remove residues and improve wettability. The felt was then fitted on a steel mesh cathode. The felt-covered cathode was immersed in the brine containing sepiolite and a vacuum applied to impregnate the felt with the dispersion until a vacuum of 23 to 27 inches was reached. The vacuum was shut off and the procedure repeated three times.

The impregnated, felt-covered cathode was installed in an electrolytic cell employing a ruthenium oxide coated titanium mesh anode and sodium chloride brine at pH of 12, a concentration of 315–320 grams of NaCl per liter and a temperature of 90° C. Current was passed through the brine at a density of 2.0 kiloamperes per square meter of anode surface. The initial brine head level was 0.5 to 1 inch greater in the anode compartment than in the cathode compartment. At start-up, a small amount (1 percent by volume of brine) of sepiolite was added to the brine to reduce the flow rate of brine through the diaphragm at the low head levels employed. The permeability of the impregnated diaphragm was found to be in the range of from about 200 to about 250 milliliters per square meter per minute of diaphragm by measuring the rate of the catholyte liquor produced.

The cell operated continuously for four weeks with the head level remaining at 1.0 inch and required no further addition of sepiolite. A catholyte liquor was produced having a sodium hydroxide concentration in the range of 136–144 grams per liter and a sodium chloride concentration in the range of 130–140 grams per liter. The cell operated at a voltage of 3.3–3.4 volts with a cathode current efficiency in the range of 91–95 percent.

EXAMPLE 2

A porous diaphragm was produced by attaching a section of polytetrafluoroethylene felt 0.068 of an inch thick to a section of glass felt 0.125 of an inch thick. C-type glass fibers 20 to 30 millimeters long and 3 to 5 microns thick were used to make the glass felt. Polytetrafluoroethylene yarn was used to join the two felt sections. The finished diaphragm had an air permeability of from about 20 to about 30 cubic feet per minute.

What is claimed is:

1. A porous diaphragm for an electrolytic cell for the electrolysis of alkali metal chloride brines which comprises a support fabric of thermoplastic materials impregnated with a mixture comprising glass fibers and a non-fibrous component containing silica.

2. The porous diaphragm of claim 1 in which said mixture is capable of hydration in contact with an aqueous solution of a compound selected from the group consisting of alkali metal chlorides, alkali metal hydroxides, and mixtures of alkali metal chlorides and alkali metal hydroxides.

3. The porous diaphragm of claim 2 in which said diaphragm has a permeability to said alkali metal chloride brines of from about 100 to about 300 milliliters per minute per square meter of said diaphragm at a head level difference in said cell of from about 0.1 to about 20 inches of said alkali metal chloride brines.

4. The porous diaphragm of claim 1 in which said non-fibrous component containing silica is selected from the group consisting of sand, quartz, silica sand, colloidal silica, chalcedony, cristobalite and tripolite.

5. The porous diaphragm of claim 4 having an additive containing magnesium selected from the group consisting of magnesia, magnesium acetate, magnesium aluminate, magnesium carbonate, magnesium chloride, magnesium hydroxide, magnesium oxide, magnesium peroxide, magnesium silicate, magnesite, periclase, dolomites and mixtures thereof, said additives being employed in amounts of from about 10 to to about 70 percent by weight of said active component containing silica.

6. The porous diaphragm of claim 4 having an additive containing aluminum selected from the group consisting of alumina, aluminum acetate, aluminum chlorate, aluminum chloride, aluminum hydroxide, aluminum oxides ($\alpha$, $\beta$ and $\gamma$), aluminum silicate, corundum, bauxites and mixtures thereof, said additives being employed in amounts of from about 10 to about 70 percent by weight of said active component containing silica.

7. The porous diaphragm of claim, 1 in which said non-fibrous component containing silica is selected from the group consisting of magnesium silicates, sepiolites, meerschaums, augites, talcs, vermiculites and mixtures thereof.

8. The porous diaphragm of claim 7 in which said support fabric has an air permeability of from about 1 to about 500 cubic feet per minute per square foot of support fabric.

9. The porous diaphragm of claim 8 in which said support fabric is a felt fabric.

10. The porous diaphragm of claim 9 in which said support fabric is a polyolefin selected from the group consisting of olefins having from 2 to about 6 carbon atoms and their chloro- and fluoro-derivatives.

11. The porous diaphragm of claim 10 in which said support fabric is a polyolefin selected from the group consisting of polypropylene, polytetrafluoroethylene, fluorinated, ethylene-propylene, polychlorotrifluoroethylene, polyvinyl fluoride and polyvinylidene fluoride.

12. The porous diaphragm of claim 11 in which said polyolefin compound is selected from the group consisting of polypropylene, polytetrafluoroethylene and polyvinylidene fluoride.

13. The porous diaphragm of claim 12 in which said polyolefin compound is polytetrafluoroethylene.

14. The porous diaphragm of claim 13 in which said glass fibers are fabricated from groups consisting of a glass selected from the group consisting of silica glass, alkali metal silicate glass, quartz glass, soda-lime glass, and mixtures thereof.

15. The porous diaphragm of claim 14 in which said glass fibers have a thickness of from about 1 microns to about 200 microns and a length of from about 5 to about 50 millimeters.

16. The porous diaphragm of claim 15 in which said support fabric has an air permeability of from about 50 to about 100 cubic feet/minute/square foot of support fabric.

17. The porous diaphragm of claim 16 in which said non-fibrous component containing silica is selected from the group consisting of magnesium silicates, sepiolites and meerschaums.

18. The porous diaphragm of claim 17 in which said mixture contains a ratio by weight of said non-fibrous component containing silica to said glass fibers of from about 3:2 to about 2:3.

19. The porous diaphragm of claim 18 in which said mixture is present at a concentration of from about 10 to about 75 milligrams per square centimeter of support fabric.

20. The porous diaphragm of claim 19 in which said glass fibers are soda-lime glasses.

21. The porous diagram of claim 20 in which said non-fibrous component containing silica is sepiolites.

22. The porous diaphragm of claim 19 in which said glass fibers are quartz glass.

23. The porous diaphragm of claim 12 in which said polyolefin compound is polyvinylidene fluoride.

24. The diaphragm of claim 13 in which said glass fibers are inorganic oxide glasses selected from the group consisting of cerium oxide glasses and germanium oxide glasses.

25. The porous diaphragm of claim 7 in which said support fabric is a polyarylene sulfide selected from the group consisting of polyphenylene sulfide, polynaphthalene sulfide, poly (perfluorophenylene) sulfide, and poly (methylphenylene) sulfide.

26. The porous diaphragm of claim 25 in which said support fabric is polyphenylene sulfide.

27. The porous diaphragm of claim 1 or 26 in which said mixture contains a ratio by weight of said non-fibrous component containing silica to said glass fibers of from about 4:1 to about 1:4.

28. The porous diaphragm of claim 27 in which said mixture is present at a concentration of from about 10 to about 75 milligrams per square centimeter of support fabric.

29. The porous diaphragm of claim 26 in which said mixture is present in said support fabric at a concentration of from about 30 to about 50 milligrams per square centimeter of support fabric.

30. In an electrolytic diaphragm cell for the electrolysis of alkali metal chloride brines having an anode assembly containing a plurality of foraminous metal anodes, a cathode assembly having a plurality of foraminous metal cathodes, a diaphragm covering said cathodes, and a cell body housing said anode assembly and said cathode assembly, the improvement which comprises using the porous diaphragm of claim 28.

31. A porous diaphragm for an electrolytic cell for the electrolysis of alkali metal chloride brines which comprises a support fabric of thermoplastic materials having a first portion impregnated with a mixture comprising glass fibers and a non-fibrous component containing silica and a second portion free of said mixture.

32. The porous diaphragm of claim 31 in which said support fabric is a polyolefin selected from the group consisting of polytetrafluoroethylene, fluorinated ethylene-propylene, polychlorotrifluoroethylene, polyvinyl fluoride and polyvinylidene fluoride.

33. The porous diaphragm of claim 26 or 32 in which said non-fibrous component containing silica is selected from the group consisting of magnesium silicates, sepiolites and meerschaums.

34. The porous diaphragm of claim 33 in which said first portion and said second portion are comprised of polytetrafluoroethylene.

35. The porous diaphragm of claim 34 in which said second portion is a felt fabric.

36. The porous diaphragm of claim 35 in which second portion has an air permeability of from about 1 to about 15 cubic feet per minute per square foot of support fabric.

37. The porous diaphragm of claim 36 in which said mixture contains a ratio by weight of said non-fibrous component containing silica to said glass fibers of from about 4:1 to about 1:4.

38. The porous diaphragm of claim 37 in which said glass fibers have a thickness of from about 4 microns to about 100 microns and a length of from about 5 to about 50 millimeters.

39. The porous diaphragm of claim 38 in which said mixture is present in said first portion at a concentration of from about 10 to about 75 milligrams per square centimeter of support fabric.

40. In an electrolytic diaphragm cell for the electrolysis of alkali metal chloride brines having an anode assembly containing a plurality of foraminous metal anodes, a cathode assembly having a plurality of foraminous metal cathodes, a diaphragm covering said cathodes, and a cell body housing said anode assembly and said cathode assembly, the improvement which comprises using the porous diaphragm of claim 31.

41. A porous diaphragm for an electrolytic cell for the electrolysis of alkali metal chloride brines which comprises a support fabric of thermoplastic materials having a first portion impregnated with glass fibers and a second portion free of said glass fibers.

42. The porous diaphragm of claim 41 in which said glass fibers have a thickness of from about 4 microns to about 100 microns and have a length of from about 5 to about 50 millimeters.

43. The porous diaphragm of claim 42 in which said glass fibers are fabricated from a glass selected from the group consisting of silica glass, alkali metal silicate glass, soda-lime glass, quartz glass and mixtures thereof.

44. The porous diaphragm of claim 43 in which said glass fibers are capable of hydration in contact with an aqueous solution of a compound selected from the group consisting of alkali metal hydroxides, alkali metal chlorides and mixtures of alkali metal chlorides and alkali metal hydroxides.

45. In an electrolytic diaphragm cell for the electrolysis of alkali metal chloride brines having an anode assembly containing a plurality of foraminous metal anodes, a cathode assembly having a plurality of foraminous metal cathodes, a diaphragm covering said cathodes, and a cell body housing said anode assembly and said cathode assembly, the improvement which comprises using the porous diaphragm of claim 41.

* * * * *